US009267479B2

(12) United States Patent
Kitano et al.

(10) Patent No.: US 9,267,479 B2
(45) Date of Patent: Feb. 23, 2016

(54) ENGINE STARTING DEVICE AND ENGINE STARTING METHOD

(75) Inventors: Hiroaki Kitano, Tokyo (JP); Daisuke Mizuno, Tokyo (JP); Yuhei Tsukahara, Tokyo (JP); Osamu Ishikawa, Tokyo (JP); Takeru Okabe, Tokyo (JP); Koichiro Kamei, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 91 days.

(21) Appl. No.: 13/978,776

(22) PCT Filed: Jul. 24, 2012

(86) PCT No.: PCT/JP2012/068694

§ 371 (c)(1),
(2), (4) Date: Sep. 27, 2013

(87) PCT Pub. No.: WO2013/031432

PCT Pub. Date: Mar. 7, 2013

(65) Prior Publication Data

US 2013/0289855 A1 Oct. 31, 2013

(30) Foreign Application Priority Data

Aug. 30, 2011 (JP) ..... 2011-187518

(51) Int. Cl.
*F02N 11/08* (2006.01)
*F02N 15/00* (2006.01)
(Continued)

(52) U.S. Cl.
CPC ..... *F02N 11/00* (2013.01); *F02N 11/0855* (2013.01); *F02N 15/067* (2013.01); *F02N 11/0844* (2013.01); *F02N 2200/022* (2013.01); *F02N 2250/04* (2013.01)

(58) Field of Classification Search
CPC ..... F02N 11/0851; F02N 11/0855; F02N 2200/023
USPC ..... 123/179.3, 179.4, 179.25; 74/7 R; 701/113
See application file for complete search history.

(56) References Cited

U.S. PATENT DOCUMENTS 8,302,575 B2 * 11/2012 Senda et al. ..... 123/179.4
8,355,860 B2 * 1/2013 Liu et al. ..... 701/113
(Continued)

FOREIGN PATENT DOCUMENTS

JP 2003-065191 A 3/2003
JP 2005-140030 A 6/2005
(Continued)

OTHER PUBLICATIONS

Japanese Office Action (Preliminary Notice of Reasons for Rejection) dated Mar. 11, 2014, Patent Application No. 2013-509375.

*Primary Examiner* — Hieu T Vo
*Assistant Examiner* — Arnold Castro
(74) *Attorney, Agent, or Firm* — Sughrue Mion, PLLC

(57) ABSTRACT

Provided is an engine starting device, including: starter control means for causing, when the restart condition is established during a period in which a meshing inhibition condition for a ring gear and a pinion gear is established, the pinion gear and the ring gear to mesh with each other after the meshing inhibition condition is released, thereby restarting the engine. The starter control means determines the meshing permission condition and the meshing inhibition condition based on at least an engine rotation speed, and determines the release of the meshing inhibition condition before the engine completely stops based on at least one of the engine rotation speed and an elapsed time after the establishment of the meshing inhibition condition.

10 Claims, 13 Drawing Sheets

(51) Int. Cl.
*F02N 11/00* (2006.01)
*F02N 15/06* (2006.01)

(56) References Cited

U.S. PATENT DOCUMENTS

| | | | | |
|---|---|---|---|---|
| 8,419,592 | B2 * | 4/2013 | Fujiwara | 477/167 |
| 8,504,279 | B2 * | 8/2013 | Ishikawa et al. | 701/112 |
| 8,631,778 | B2 * | 1/2014 | Moriya et al. | 123/179.4 |
| 8,671,903 | B2 * | 3/2014 | Notani | 123/179.4 |
| 2004/0221828 | A1 * | 11/2004 | Ries-Mueller et al. | 123/179.3 |
| 2007/0068476 | A1 | 3/2007 | Asada | |
| 2007/0084429 | A1 * | 4/2007 | Taki et al. | 123/179.4 |
| 2007/0137602 | A1 * | 6/2007 | Kassner | 123/179.25 |
| 2008/0262707 | A1 * | 10/2008 | Yamaguchi | 701/112 |
| 2009/0224557 | A1 * | 9/2009 | Reynolds et al. | 290/38 R |
| 2010/0050970 | A1 * | 3/2010 | Okumoto et al. | 123/179.4 |
| 2010/0059007 | A1 * | 3/2010 | Senda et al. | 123/179.4 |
| 2010/0180849 | A1 * | 7/2010 | Senda et al. | 123/179.4 |
| 2010/0251852 | A1 * | 10/2010 | Murata et al. | 74/7 A |
| 2012/0103294 | A1 * | 5/2012 | Kitano et al. | 123/179.25 |
| 2013/0289855 | A1 * | 10/2013 | Kitano et al. | 701/113 |

FOREIGN PATENT DOCUMENTS

| | | | |
|---|---|---|---|
| JP | 2007-107527 | A | 4/2007 |
| JP | 2007-270793 | A | 10/2007 |
| JP | 2010-084754 | A | 4/2010 |
| JP | 2011-099455 | A | 5/2011 |
| JP | 2012-031819 | A | 2/2012 |
| WO | 2011-024511 | A1 | 3/2011 |
| WO | 2013/021812 | A1 | 2/2013 |

* cited by examiner

ENGINE STARTING DEVICE AND ENGINE STARTING METHOD

CROSS REFERENCE TO RELATED APPLICATIONS

This application is a National Stage of International Application No. PCT/JP2012/068694 filed Jul. 24, 2012, claiming priority based on Japanese Patent Application No. 2011-187518 filed Aug. 30, 2011, the contents of all of which are incorporated herein by reference in their entirety.

TECHNICAL FIELD

The present invention relates to an engine starting device and an engine starting method for an automatic idle-stop system for performing an engine idle stop when a predetermined idle-stop condition is satisfied and restarting the engine when a restart condition is thereafter satisfied.

BACKGROUND ART

Hitherto, for the purposes of improving fuel efficiency and reducing an environmental load of automobiles, and for other such purposes, there have been developed automatic idle-stop systems for automatically performing an idle stop with the satisfaction of a predetermined condition. However, it takes time for the engine rotation to be completely stopped by a friction force, and a conventional idle-stop system cannot carry out the restart during this period.

Thus, as a method for solving this problem, for example, there is a method involving, in a start control device for an internal combustion engine, when start rpm determination means determines that the rpm of the internal combustion engine decreases to an rpm enabling engagement of a rotation drive mechanism with the internal combustion engine, engaging the rotation drive mechanism with the internal combustion engine, thereby rotationally driving the internal combustion engine (for example, refer to PTL 1).

Moreover, there is an engine automatic stop/start control device including a starter capable of individually actuating a motor for rotationally driving a pinion, and an actuator for causing the pinion to mesh with a ring gear coupled to a crankshaft of an engine. If, in an engine rotation decreasing period in which the engine rpm decreases due to an automatic stop of the engine, an engine restart request is generated when the engine rpm is in a predetermined rpm area, after or while the engine automatic stop/start control device causes or is causing the pinion to mesh with the ring gear by the actuator, the engine automatic stop/start control device rotates the pinion by the motor, thereby starting cranking by the starter, and restarts the engine (for example, refer to PTL 2).

Moreover, there is known an engine starting device for carrying out determination processing of determining, when a restart request for an engine occurs, whether or not an engine rpm is equal to or lower than a predetermined meshing enabling rpm, first electric power supply processing of supplying a solenoid with electric power when the determination processing determines that the engine rpm is equal to or lower than the meshing enabling rpm, condition determination processing of determining whether or not a predetermined condition is established after the first electric power supply processing, and second electric power supply processing of supplying the starter motor with electric power when the condition determination processing determines that the condition is established (for example, refer to PTL 3).

CITATION LIST

Patent Literature

[PTL 1] JP 2003-65191 A
[PTL 2] JP 2011-99455 A
[PTL 3] JP 2010-84754 A

SUMMARY OF INVENTION

Technical Problem

However, the conventional technologies have the following problems.

According to PTL 1, the engine can surely be restarted earlier than in a case where complete stop of the engine is waited for, and the engine is restarted by causing the pinion gear and the ring gear to mesh with each other. However, generally, the engine repeats a forward rotation and a backward rotation around 0 rpm during an inertial rotation, and when the engine is rotating backward, the pinion gear possibly meshes with the ring gear.

Moreover, according to PTL 2, the restart of the engine can also be realized earlier than in the case where complete stop of the engine is waited for. However, PTL 2 does not mention anything about meshing during the backward rotation. Moreover, though there is a description of meshing by the actuator with the pinion gear before the backward rotation, a structure for individually operating the motor and the actuator is prerequisite. Therefore, there arises such a problem that the number of components, dimensions, the weight, and the like increase compared with those of conventional starters.

Moreover, the meshing is carried out each time the engine stops, and hence a meshing noise is generated independently of an operation by a driver, which may make the driver feel a sense of discomfort.

Moreover, in the device according to PTL 3, the meshing is not inhibited during the backward rotation of the engine, and such a structure that the motor and the actuator are individually operated is assumed. Moreover, this solution cannot be applied to a starter in which the movement of the pinion gear and the rotation of the starter motor cannot be individually carried out, and it is thus necessary to more precisely estimate the backward rotation behavior of the engine.

Moreover, for example, such setting is considered that, when the meshing is inhibited during the backward rotation, if the engine rpm reaches an rpm lower than a predetermined rpm (on a minus side with respect to the predetermined rpm) and then again increases to an rpm equal to or higher than the predetermined rpm, the inhibition of the meshing is released. In this case, if an amount of the backward rotation is large, after the inhibition of meshing, the engine rpm decreases to an rpm lower than the predetermined rpm and then again increases to an rpm equal to or higher than the predetermined rpm, the inhibition of meshing is released, but if the amount of the backward rotation is small, after the inhibition of meshing, the engine rpm does not decrease to an rpm lower than the predetermined rpm, and the inhibition of meshing cannot be released. Therefore, only the comparison between the engine rpm and the predetermined rpm may not release the inhibition of meshing.

The present invention has been devised to solve the above-mentioned problems, and has an object to provide an engine starting device and an engine starting method capable of restraining an impact between a pinion gear and a ring gear during meshing, thereby quickly and quietly restarting an engine during an inertial rotation in an automatic idle-stop system.

Solution to Problem

According to the present invention, there is provided an engine starting device for an automatic idle-stop system for carrying out an idle-stop of an engine when a predetermined idle-stop condition is established, and then restarting the engine when a restart condition is established, the engine starting device including: a starter; a ring gear to be coupled to a crankshaft of the engine; a starter motor for starting the engine; a pinion gear for transmitting a rotation of the starter motor to the ring gear; and starter control means for causing, when the restart condition for the engine is established during a period in which a meshing permission condition for the ring gear and the pinion gear is established, the pinion gear and the ring gear to mesh with each other, thereby restarting the engine, and for inhibiting, when the restart condition is established during a period in which a meshing inhibition condition for the ring gear and the pinion gear is established, the meshing of the pinion gear and the ring gear so that the meshing of the pinion gear and the ring gear is prevented from occurring outside a meshing permissible range, and after the meshing inhibition condition is released, causing the pinion gear and the ring gear to mesh with each other, thereby restarting the engine, in which the starter control means determines the meshing permission condition and the meshing inhibition condition based on at least an engine rpm, and determines the release of the meshing inhibition condition before the engine completely stops based on at least one of the engine rpm and an elapsed time after the establishment of the meshing inhibition condition.

Further, according to the present invention, there is provided an engine starting method for an automatic idle-stop system for carrying out an idle-stop of an engine when a predetermined idle-stop condition is established, and then restarting the engine when a restart condition is established, the engine starting method being applied to an engine starting device including: a starter; a ring gear to be coupled to a crankshaft of the engine; a starter motor for starting the engine; a pinion gear for transmitting a rotation of the starter motor to the ring gear; and starter control means for causing, when the restart condition for the engine is established during a period in which a meshing permission condition for the ring gear and the pinion gear is established, the pinion gear and the ring gear to mesh with each other, thereby restarting the engine, and for inhibiting, when the restart condition is established during a period in which a meshing inhibition condition for the ring gear and the pinion gear is established, the meshing of the pinion gear and the ring gear so that the meshing of the pinion gear and the ring gear is prevented from occurring outside a meshing permissible range, and after the meshing inhibition condition is released, causing the pinion gear and the ring gear to mesh with each other, thereby restarting the engine, the engine starting method including: determining, by the starter control means, the meshing permission condition and the meshing inhibition condition based on at least an engine rpm; and determining, by the starter control means, the release of the meshing inhibition condition before the engine completely stops based on at least one of the engine rpm and an elapsed time after the establishment of the meshing inhibition condition.

Advantageous Effects of Invention

According to the present invention, it is possible to provide the engine starting device and the engine starting method capable of restraining the impact between the pinion gear and the ring gear during the meshing by determining the meshing permission condition and the meshing inhibition condition based on at least the engine rpm, and determining the release of the meshing inhibition condition based on at least one of the engine rpm and the elapsed time after the establishment of the meshing inhibition condition, thereby quickly and quietly restarting the engine during the inertial rotation in the automatic idle-stop system.

DESCRIPTION OF EMBODIMENTS

Figure 1:
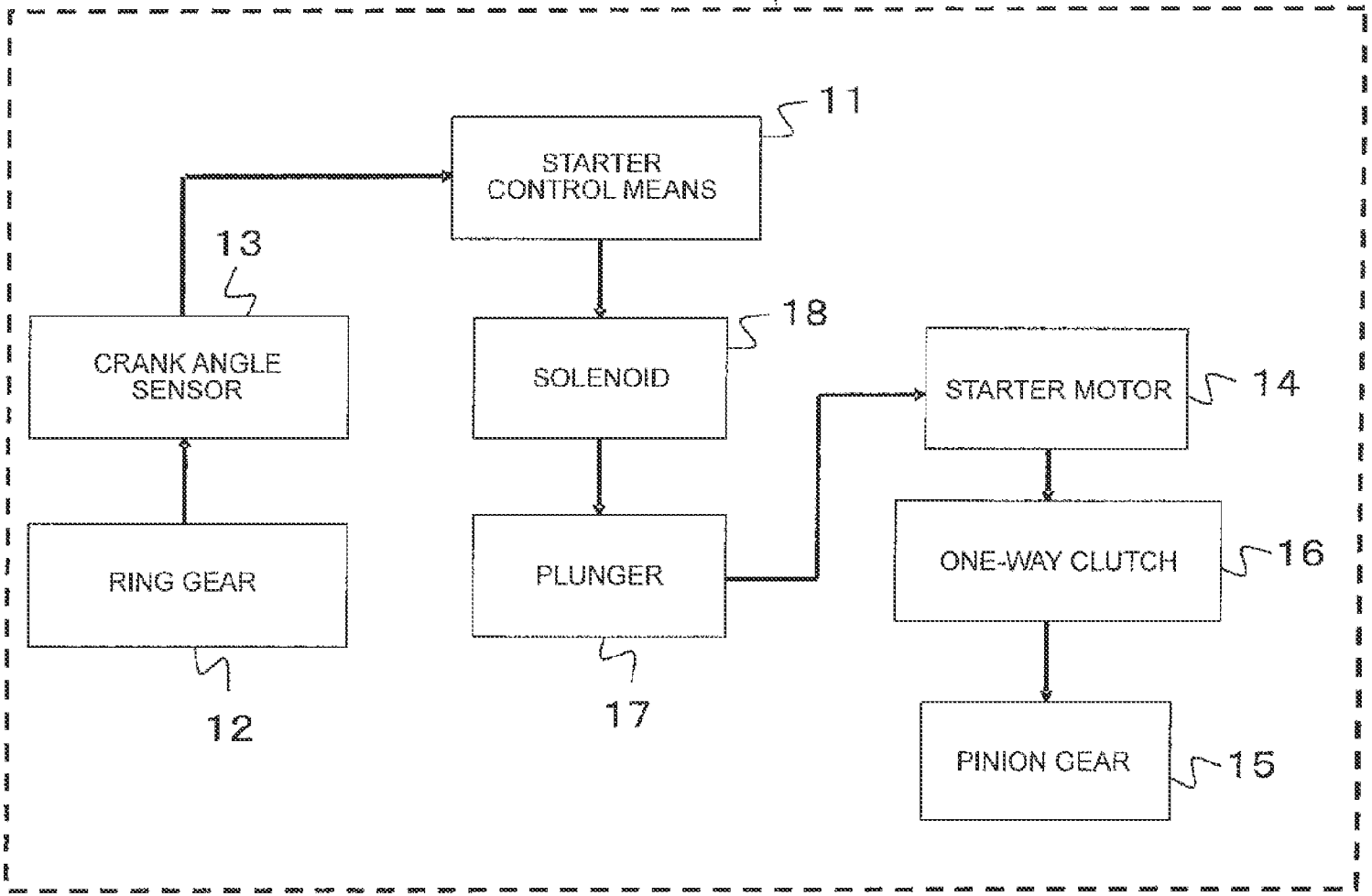
FIG. 1A block diagram illustrating a schematic configuration of an engine starting device according to a first embodiment of the present invention.

Referring to the drawings, a description is now given of an engine starting device and an engine starting method for a four-cylinder engine, as an example, according to preferred embodiments of the present invention.

First Embodiment

Figure 2:
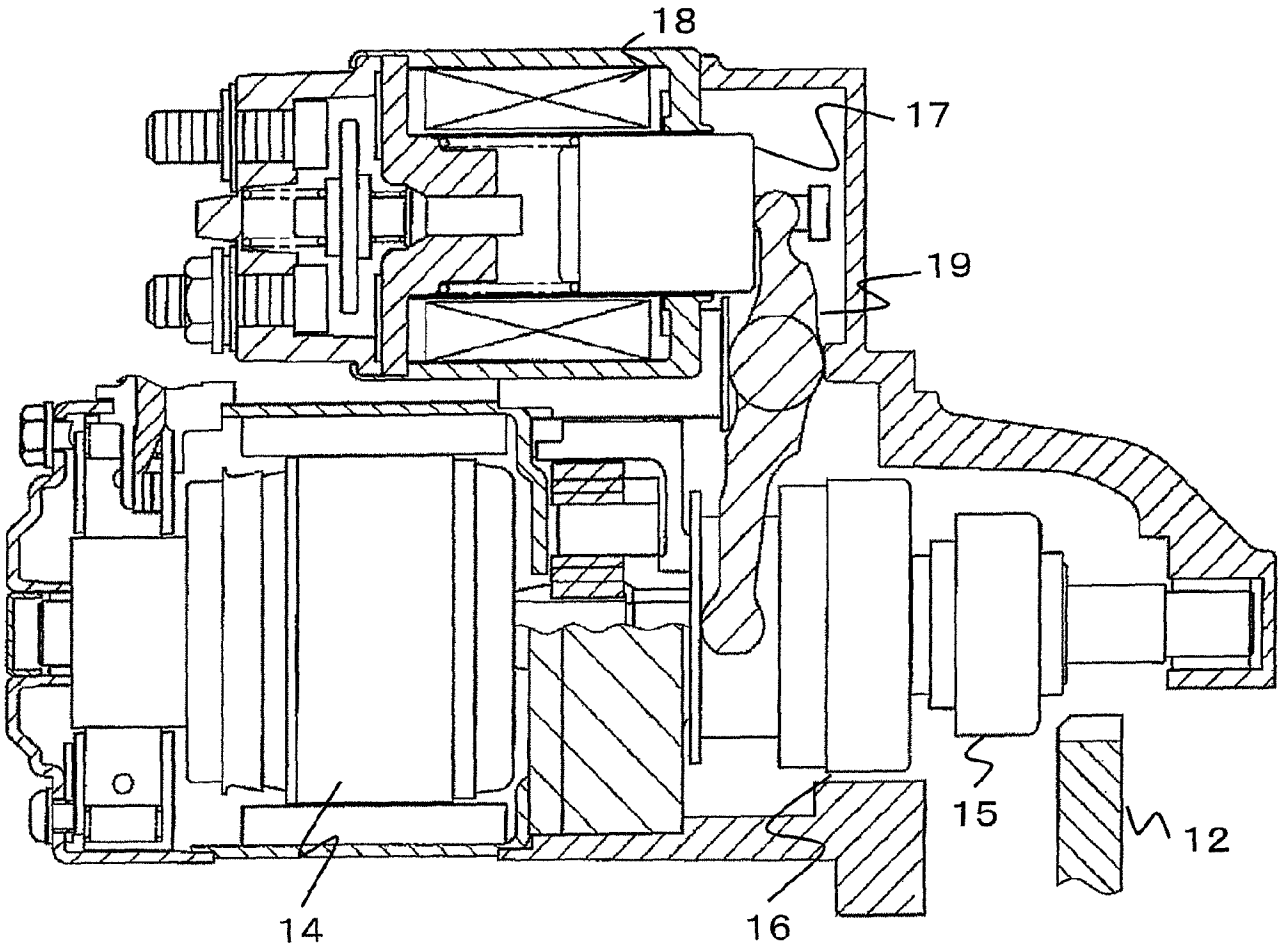
FIG. 2 A cross-sectional view illustrating a starter of the engine starting device according to the first embodiment of the present invention.

FIG. 1 is a block diagram illustrating a schematic configuration of an engine starting device 10 according to a first embodiment of the present invention. Moreover, FIG. 2 is a cross-sectional view of a starter of the engine starting device according to the first embodiment of the present invention.

The engine starting device 10 according to this embodiment illustrated in FIG. 1 includes starter control means 11, a ring gear 12, a crank angle sensor 13, a starter motor 14, a pinion gear 15, a one-way clutch 16, a plunger 17, and a solenoid 18.

The starter control means 11 controls power supply to the solenoid 18. The power supply to the solenoid 18 results in the attraction of the plunger 17, thereby moving the pinion gear 15 via a lever 19 (refer to FIG. 2) and as a result, the pinion gear 15 and the ring gear 12 mesh with each other. Moreover, the movement of the plunger 17 closes a contact, and the electric power is thus supplied to the starter motor 14, and as a result, the pinion gear 15 is rotated.

Moreover, the ring gear 12 meshes with the pinion gear 15, thereby transmitting a drive force to the engine. Moreover, the crank angle sensor 13 detects a crank angle of the engine. Moreover, the one-way clutch 16 is coupled to an output shaft of the starter motor 14, and freely rotates if a torque is input from the ring gear 12.

Then, the starter control means 11 can calculate an engine rpm based on a cycle of a rotation pulse of the crankshaft output from the crank angle sensor 13.

A description is now given of an engine inertial rotation behavior when an idle-stop condition is established in the engine starting device according to the first embodiment.

When an automatic stop condition (for example, such a condition that a vehicle speed is equal to or lower than 15 km/h, and the driver is depressing a brake) is established during a travel of a vehicle, the fuel supply to the engine is stopped, thereby bringing the engine into an inertial rotation state.

Figure 3:
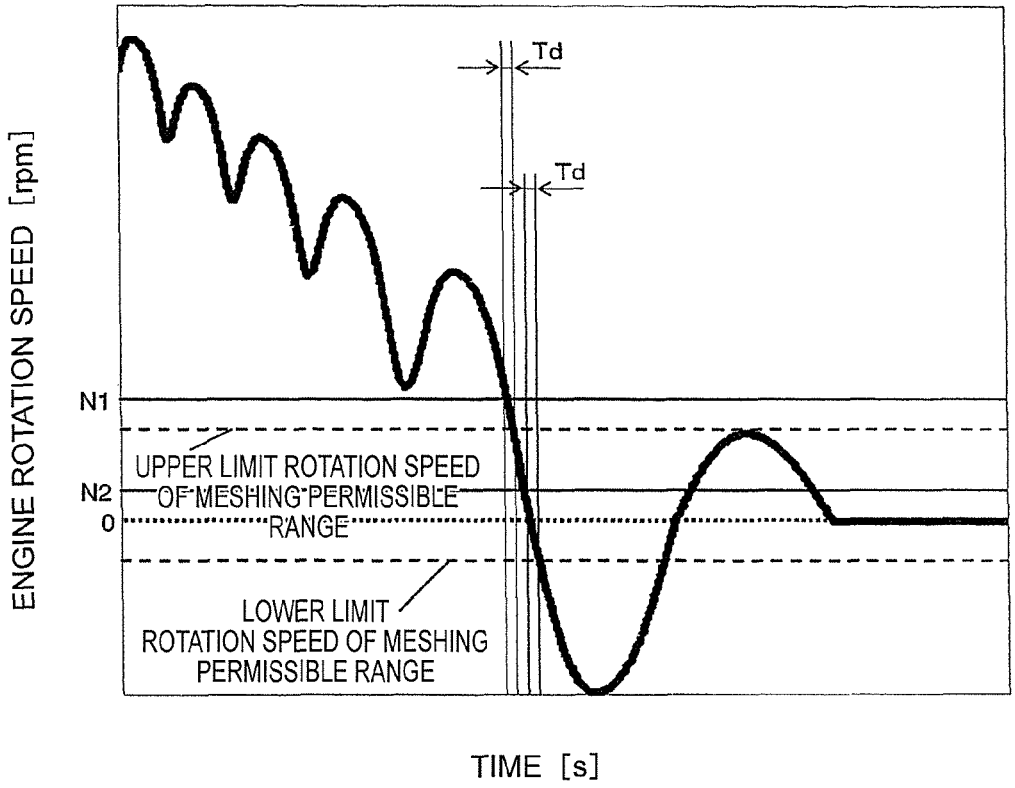
FIG. 3 A graph showing a behavior of an engine rpm during an inertial rotation according to the first embodiment of the present invention.

FIG. 3 is a graph showing a behavior of an engine rpm during the inertial rotation according to the first embodiment of the present invention. Specifically, FIG. 3 shows an engine rpm behavior when the idle-stop condition is established, the fuel supply to the engine is thus stopped, and the engine is in the inertial rotation state. As a result of the inertial rotation, the compression and expansion cycles of pistons of the engine generate a torque fluctuation, and the engine rpm decreases while presenting pulsation.

The present invention has a technical feature in that, when a restart condition is established and the engine rpm is outside a meshing permissible range represented by the broken lines of FIG. 3, the pinion gear 15 and the ring gear 12 are prevented from meshing with each other. Referring to FIGS. 6 to 10, N1 and N2 in FIG. 3 are described later.

Figure 4:
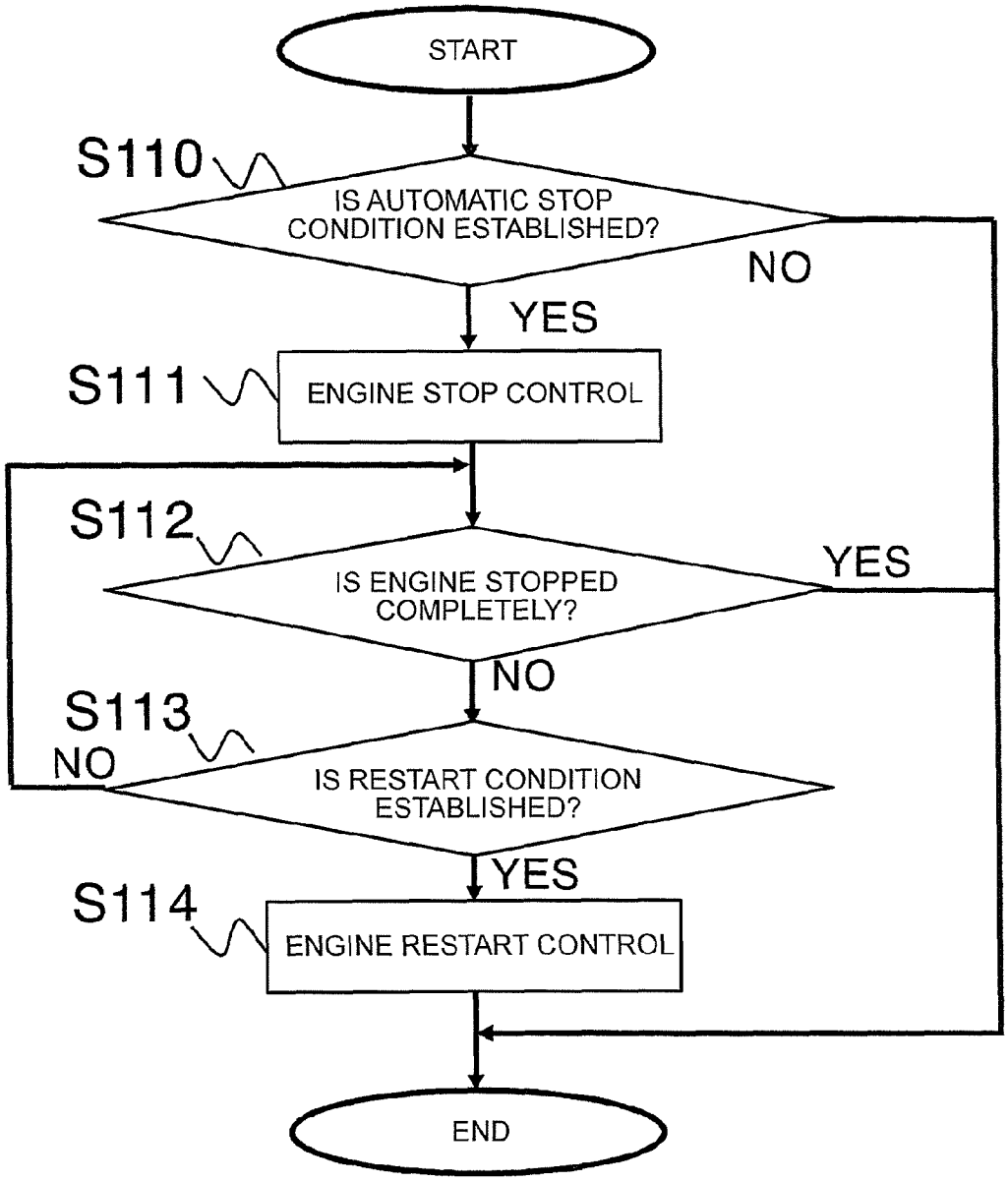
FIG. 4 A flowchart illustrating a sequence of processing relating to engine restart according to the first embodiment of the present invention.

Referring to FIG. 4, a detailed description is now given of a specific operation of the engine starting device according to the first embodiment.

FIG. 4 is a flowchart illustrating a sequence of processing relating to the engine restart according to the first embodiment of the present invention. First, in Step S110, the starter control means 11 determines whether or not the idle-stop condition is established. Then, when the starter control means 11 determines that the idle-stop condition is not established in Step S110, the starter control means 11 finishes the sequence of processing, and proceeds to the next control cycle.

On the other hand, when the starter control means 11 determines that the idle stop condition is established in Step S110, the processing proceeds to Step S111, and the starter control means 11 carries out engine stop control. Specifically, the starter control means 11 stops the fuel supply to the engine, and reduces the rpm by means of the inertial rotation.

Then, in Step S112, the starter control means 11 determines whether or not the engine is completely stopped. The determination as to whether or not the engine is completely stopped is made by whether or not a pulse for the crank angle is detected for a predetermined period (such as 300 ms). Thus, when the pulse for the crank angle is not detected for the predetermined period, the starter control means 11 determines that the engine is completely stopped, finishes the processing, and proceeds to the next cycle.

On the other hand, in Step S112, when the starter control means 11 determines that the engine is not stopped completely, the processing proceeds to Step S113, and the starter control means 11 determines whether or not the restart condition is established.

When the starter control means 11 determines that the restart condition is established, the processing proceeds to Step S114, and the starter control means 11 carries out engine restart control. On the other hand, when the starter control means 11 determines that the restart condition is not established, the processing returns to Step S112.

Figure 5:
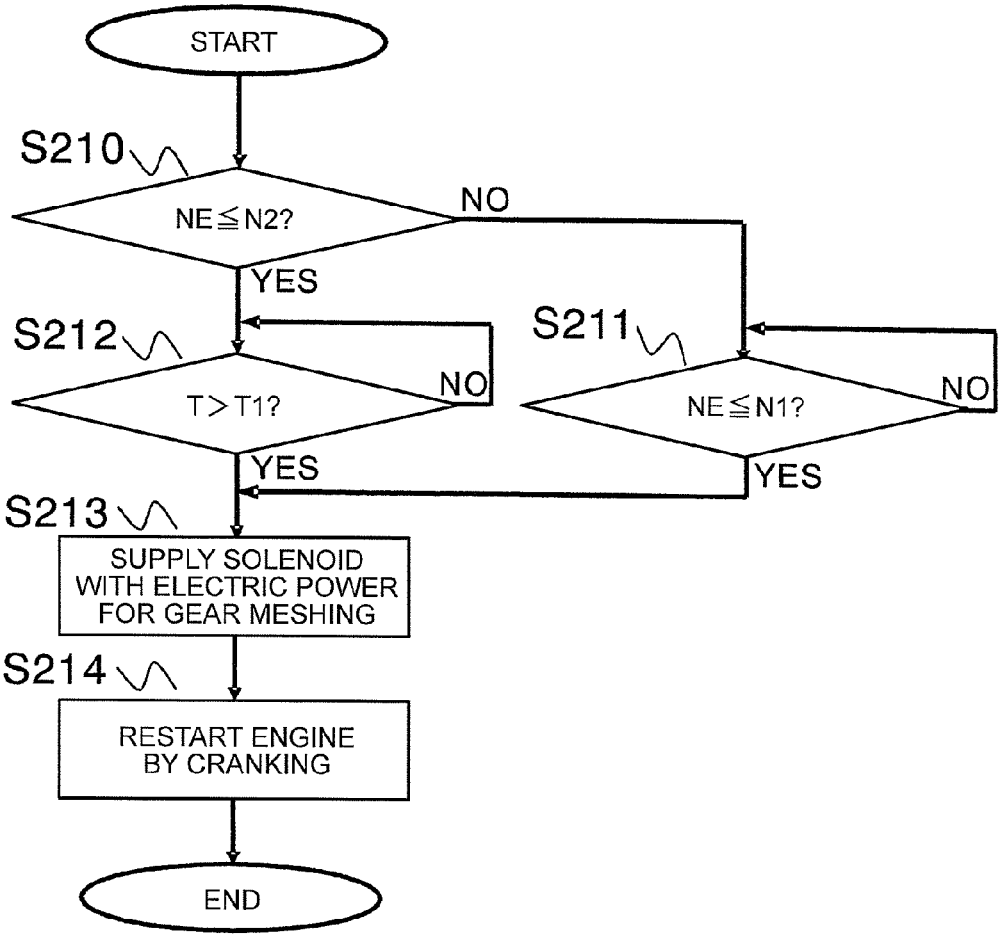
FIG. 5 A flowchart illustrating a sequence of processing relating to starter control when a restart condition is established according to the first embodiment of the present invention.

Now, a detailed description is given of the engine restart control in Step S114. FIG. 5 is a flowchart illustrating a sequence of processing relating to the starter control when the restart condition is established according to the first embodiment of the present invention.

First, in Step S210, the starter control means 11 determines whether or not the meshing inhibition condition is established. On this occasion, the establishment of the meshing inhibition condition is determined by whether or not an engine rpm NE when the power is fed to the solenoid 18 and the pinion gear 15 meshes with the ring gear 12 is equal to or lower than a second predetermined rpm N2.

A description is now given of the meshing of the pinion gear 15 and the ring gear 12 with each other. If a difference in rpm between the pinion gear 15 and the ring gear 12 is large, an impact and a noise are generated during the meshing, and the pinion gear 15 and the ring gear 12 thus need to mesh with each other in an rpm difference range (−150 rpm to 150 rpm) prescribed by an upper limit rpm of meshing permissible range (such as 150 rpm) and a lower limit rpm of meshing permissible range (such as −150 rpm).

Moreover, the meshing of the pinion gear 15 and the ring gear 12 with each other as a result of the power supply to the solenoid 18 generates a delay time Td (such as 10 ms) from the start of the power supply to the solenoid 18 to the completion of the meshing, and it is thus necessary to consider the delay time in meshing the gears with each other. Therefore, the second predetermined rpm N2 is set by considering the above-mentioned condition. Specifically, the second predetermined rpm N2 is an engine rpm the delay time Td before a time when the engine rpm reaches the lower limit rpm of meshing permissible range.

This setting enables to start the power supply to the solenoid 18 at an engine rpm higher than the second predetermined rpm N2, and when the meshing occurs after the delay time Td has elapsed, the engine rpm reaches an rpm equal to or higher than the lower limit rpm of permissible range, and hence smooth meshing is realized.

If the meshing starts at an rpm equal to or lower than the second predetermined rpm N2, the rpm when the gears actually mesh with each other is outside the permissible range, an impact torque and a noise corresponding to the rpm are generated, and the lifetime of the starter may be decreased, which are not preferred.

Thus, in Step S210, when the starter control means 11 determines that the engine rpm NE is higher than the second predetermined rpm, the processing proceeds to Step S211, and the starter control means 11 determines whether or not the meshing permission condition is established.

On this occasion, the establishment of the meshing permission condition is determined by whether or not the engine rpm NE is equal to or lower than the first predetermined rpm N1 (provided that N1>N2). When the starter control means 11 determines that the meshing permission condition is established (NE≤N1), the processing proceeds to Step S213, and the starter control means 11 supplies the solenoid 18 with electric power, thereby causing the pinion gear 15 and the ring gear 12 to mesh with each other.

On this occasion, the first predetermined rpm N1 is set by considering the upper limit rpm of meshing permissible range (such as 150 rpm) and the delay time Td. Specifically, the first predetermined rpm N1 is an engine rpm the delay time Td before a time when the engine rpm reaches the upper limit rpm of meshing permissible range. This setting enables to start the power supply to the solenoid 18 at an engine rpm equal to or lower than the first predetermined rpm N1, and when the meshing occurs after the delay time Td has elapsed, the engine rpm is equal to or lower than the upper limit rpm of permissible range, and hence smooth meshing is realized.

Moreover, in Step S211, when the engine rpm NE is higher than the first predetermined rpm N1, the starter control means 11 waits until the engine rpm NE decreases by friction to an rpm equal to or lower than N1, and then the processing proceeds to Step S213.

Moreover, when the engine rpm NE is equal to or lower than the second predetermined rpm N2 in Step S210 described above, the processing proceeds to Step S212.

Then, in Step S212, the starter control means 11 determines whether or not to release the meshing inhibition condition depending on whether or not an elapsed time T after the meshing inhibition condition is established (NE≤N2) is longer than a predetermined time T1. On this occasion, the predetermined time T1 is set to a time when the backward rotation of the engine ends, or the engine rpm falls within the rpm range sufficient for the meshing.

Figure 6:
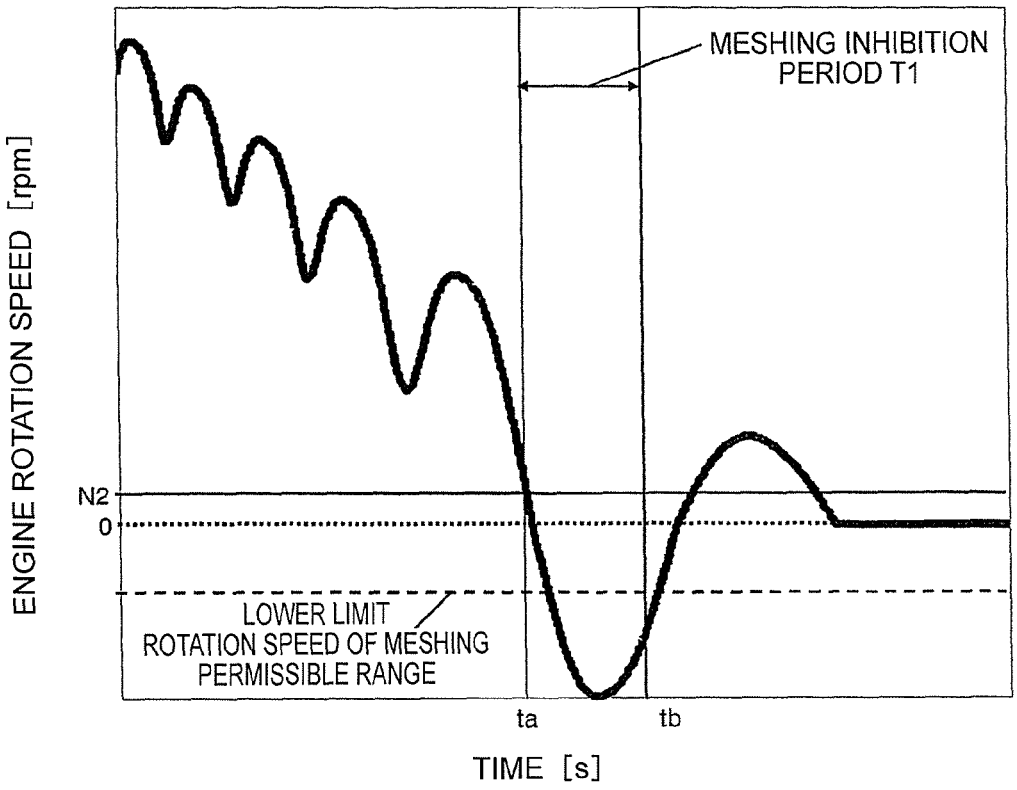
FIG. 6 A conceptual view showing a meshing inhibition period according to the first embodiment of the present invention.

Referring to FIG. 6, a description is now given of the predetermined time T1. FIG. 6 is a conceptual view showing a meshing inhibition period according to the first embodiment of the present invention. As shown in FIG. 6, during a period from a time ta when the engine rpm NE reaches an engine rpm equal to or lower than the second predetermined rpm N2 to a time tb when the predetermined time T1 has elapsed after ta, even if the restart condition is established, the starter control means 11 inhibits the meshing of the pinion gear 15 and the ring gear 12 with each other, and supplies the solenoid 18 with the electric power when the predetermined time T1 has elapsed, thereby causing the pinion gear 15 and the ring gear 12 to mesh with each other.

Moreover, the elapsed time T is an elapsed time after the engine rpm NE reaches an rpm equal to or lower than the predetermined rpm N2 irrespective of whether or not the restart condition is established. Then, when the starter control means 11 determines that the elapsed time T after the meshing inhibition condition is established is longer than the predetermined time T1, the starter control means 11 releases the establishment of the meshing inhibition condition, and the processing proceeds to Step S213.

Then, in Step S213, the starter control means 11 supplies the solenoid 18 with electric power, thereby causing the pinion gear 15 and the ring gear 12 to mesh with each other. As a result, the meshing of gears with each other at an rpm outside the meshing permissible range during the backward rotation of the engine can surely be avoided, to thereby realize quiet and smooth meshing of the gears.

Then, the processing proceeds to Step S214, and the starter control means 11 causes the pinion gear 15 and the ring gear 12 to mesh with each other, and then restarts the engine by cranking.

As described above, the engine starting device according to the first embodiment determines, based on at least the engine rpm, whether or not the meshing permission condition and the meshing inhibition condition are established, and further determines whether or not to release the establishment of the meshing inhibition condition based on the elapsed time after the inhibition condition is established.

As a result, the meshing of the pinion gear and the ring gear with each other can be carried out quickly and surely, and hence the meshing of the gears can be carried out within the meshing permissible range without making the driver feel a sense of discomfort, and the reduction in noise and restraint of the impact torque at the time of the meshing of the pinion gear and the ring gear with each other, and an increase in lifetime of components can be attained.

Note that, according to the first embodiment described above, the meshing inhibition condition is established when the engine rpm NE reaches an rpm equal to or lower than the second predetermined rpm N2, but the establishment of the inhibition condition is not limited to this case. When the meshing inhibition condition is once established, and the establishment of the inhibition condition is released after the predetermined time T1 has elapsed, the engine restarts, and the inhibition condition may be prevented from being established until the next idle-stop.

This is because second and later backward rotation amounts are small, and this control can prevent the meshing inhibition condition from being established when the engine rotates backward once and then rotates forward, and the engine rpm NE decreases again to an rpm equal to or lower than the second predetermined rpm N2. As a result, unnecessary meshing inhibition can be prevented, and a quick restart of the engine can be realized.

Moreover, generally, the engine rpm is often calculated based on the cycle of a pulse generated each time the engine rotates by a predetermined crank angle, but the engine rpm may be calculated by considering a period in which the pulse of the each crank angle is not present as well.

The calculation method based only on the crank angle pulse does not update the engine rpm while the crank angle pulse is not present, and there is a case where a delay is generated with respect to the actual engine rpm. In contrast, by considering the period in which the crank angle pulse is not present as well, the release of the meshing inhibition can be determined based on an engine rpm corresponding to the actual engine rpm.

Moreover, in the above-mentioned first embodiment, a description has been given of the starter (corresponding to a widely prevailing single solenoid type starter) operationally associating the power supply to the solenoid 18 and the power supply to the starter motor 14 with each other as an example. The engine starting method according to the present invention can be applied to this starter, and does not require changes in engine layout and changes in manufacturing line.

However, the application of the present invention is not limited to this starter, and the present invention can be applied to a starter which can independently control the power supply to the solenoid and the power supply to the starter motor, and the above-mentioned effects can be acquired also in this case.

Second Embodiment

In the above-mentioned first embodiment, the first predetermined rpm N1 and the second predetermined rpm N2 are set as constant rpms. However, these predetermined rpms are not necessarily constant values, and the values may be set for each crank angle depending on engine pulsation, for example.

Thus, according to a second embodiment, referring to FIGS. 7 to 10, a description is given of a case where the first predetermined rpm N1 and the second predetermined rpm N2 are defined depending on the crank angle of the engine.

Figure 7:
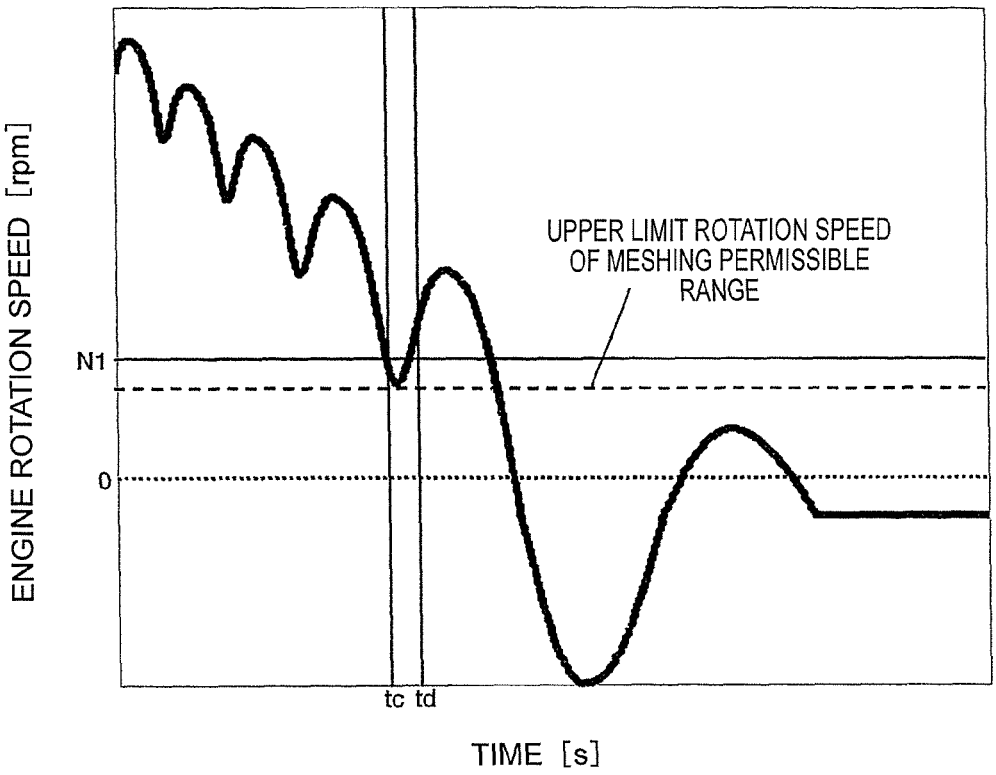
FIG. 7 A conceptual view showing a case where a first predetermined rpm is a constant value according to a second embodiment of the present invention.

FIG. 7 is a conceptual view showing a case where the first predetermined rpm N1 is a constant value according to the second embodiment of the present invention. On the other hand, FIG. 8 is a conceptual view showing a case where the first predetermined rpm is changed depending on the crank angle of the engine according to the second embodiment of the present invention.

During the inertial rotation of the engine, before and after the compression top dead center, the compression stroke and the expansion stroke are switched, and hence the sign of a rotational acceleration is inverted. Thus, as shown in FIG. 7, if the relationship of NE≤N1 holds true immediately before or after the compression dead center (time tc), and the power supply to the solenoid 18 thus starts, the engine rpm may increase and exceed the meshing permissible range at a time point (time td) when the pinion gear 15 meshes with the ring gear 12.

Figure 8:
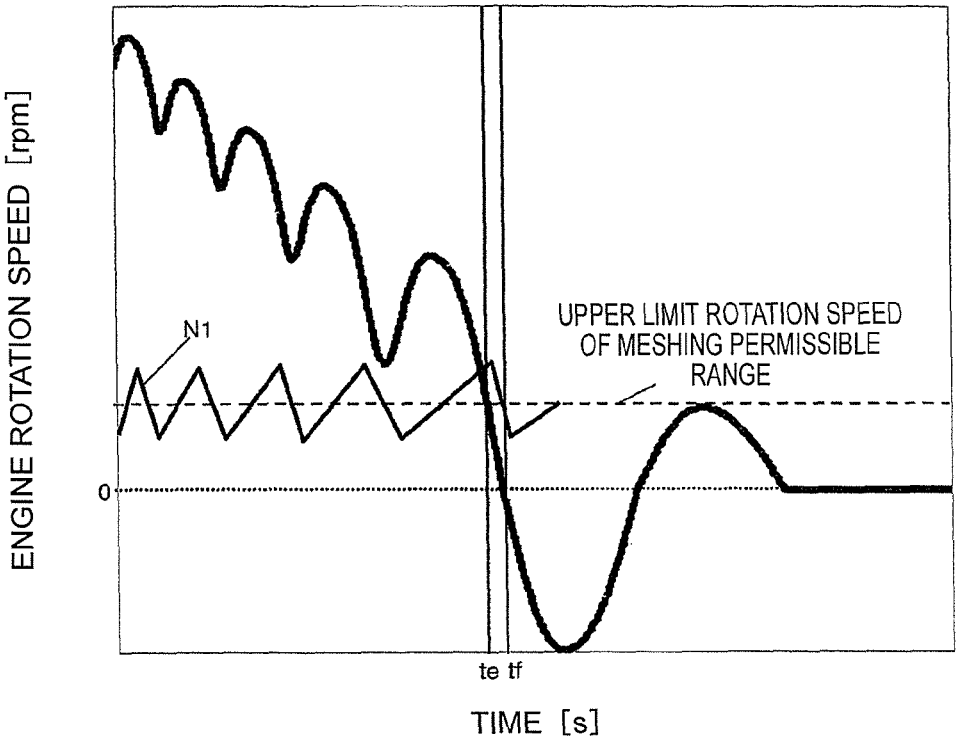
FIG. 8 A conceptual view showing a case where the first predetermined rpm is changed depending on a crank angle of the engine according to the second embodiment of the present invention.

Thus, as shown in FIG. 8, if the first predetermined rpm N1 is associated with the crank angle, and the power supply to the solenoid 18 starts at a time point (time te) when the relationship of NE≤N1 holds true, the engine rpm subsequently does not increase until the gears mesh with each other, and the engine rpm NE falls within the meshing permissible range at a time point (time tf) when the pinion gear 15 meshes with the ring gear 12.

In this way, according to the second embodiment, there may be provided control of changing the first predetermined rpm N1 depending on the crank angle, thereby supplying the solenoid 18 with the electric power so that the engine rpm NE when the pinion gear 15 meshes with the ring gear 12 surely falls within the meshing permissible range.

Figure 9:
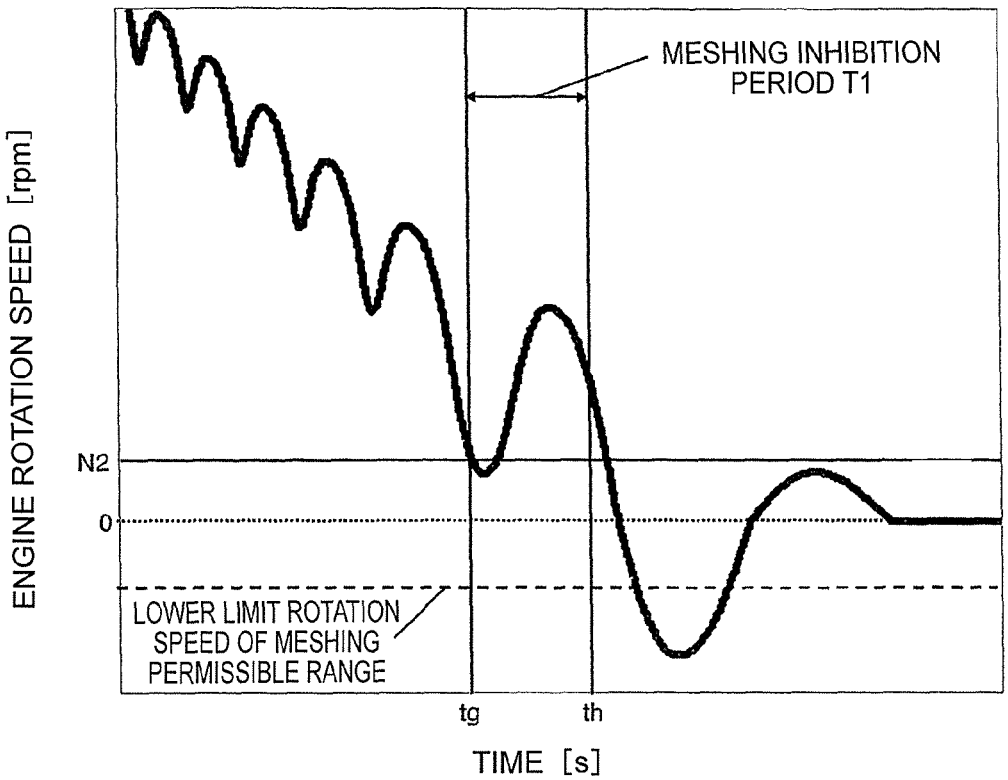
FIG. 9 A conceptual view showing a case where a second predetermined rpm is a constant value according to the second embodiment of the present invention.

A description is now given of a case where the second predetermined rpm N2 is changed depending on the crank angle. FIG. 9 is a conceptual view showing the case where the second predetermined rpm N2 is a constant value according to the second embodiment of the present invention. On the other hand, FIG. 10 is a conceptual view showing a case where the second predetermined rpm N2 is changed depending on the crank angle of the engine according to the second embodiment of the present invention.

As described above, during the inertial rotation of the engine, before and after the compression top dead center, the compression stroke and the expansion stroke are switched. Therefore, as shown in FIG. 9, if N2 is a constant value, at a time tg, the relationship of NE≤N2 holds true and hence the meshing inhibition condition is established. Then, the meshing is inhibited for the predetermined period T1 (until a time th). However, the compression top dead center is passed immediately after a time tg, and the engine rpm thus increases, and hence the meshing may not be inhibited during an intended period (period in which the meshing occurs at an rpm equal to or lower than the lower limit rpm of meshing permissible range).

Figure 10:
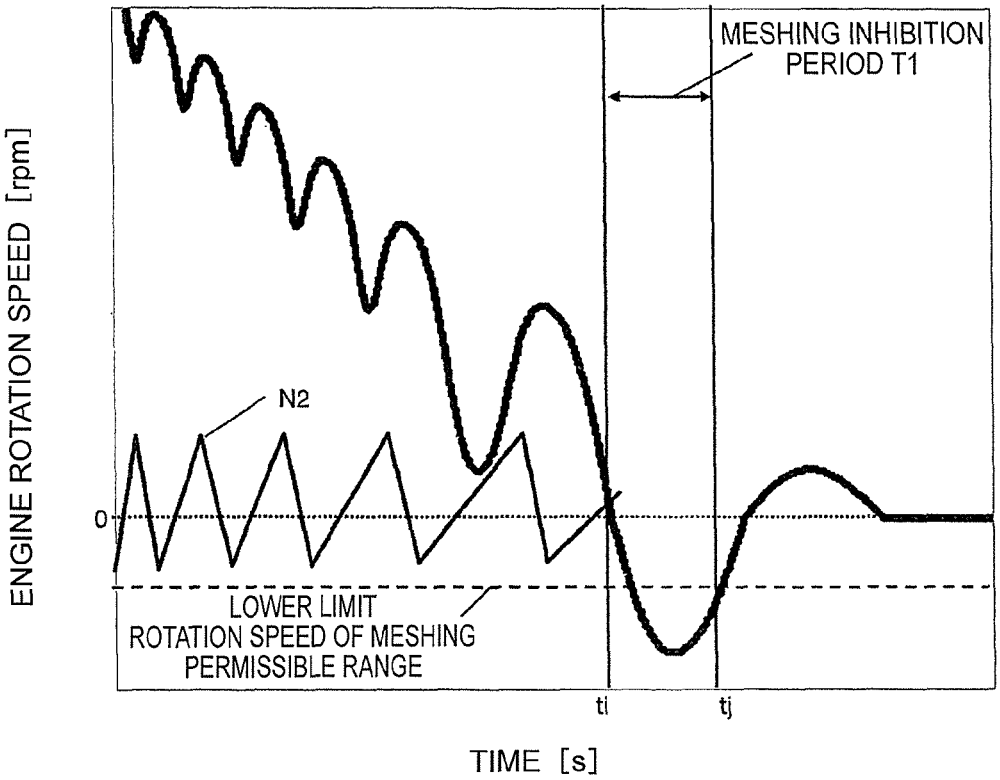
FIG. 10 A conceptual view showing a case where the second predetermined rpm is changed depending on the crank angle of the engine according to the second embodiment of the present invention.

Thus, as shown in FIG. 10, by changing the second predetermined rpm N2 depending on the crank angle, if the meshing is inhibited at a time point (time ti) when the relationship of NE≤N2 holds true, the meshing can be properly inhibited in consideration of the delay time from the start of the power supply to the solenoid 18 to the actual meshing of the pinion gear 15 with the ring gear 12, only in a period (time ti-tj) in which the meshing inhibition is necessary.

In this way, according to the second embodiment, there may be provided control of changing the second predetermined rpm N2 depending on the crank angle, thereby surely inhibiting the meshing in the case where the engine rpm NE at a time when the solenoid 18 is supplied with the electric power so as to cause the pinion gear 15 to mesh with the ring gear 12 is equal to or lower than the meshing permissible range.

Figure 11:
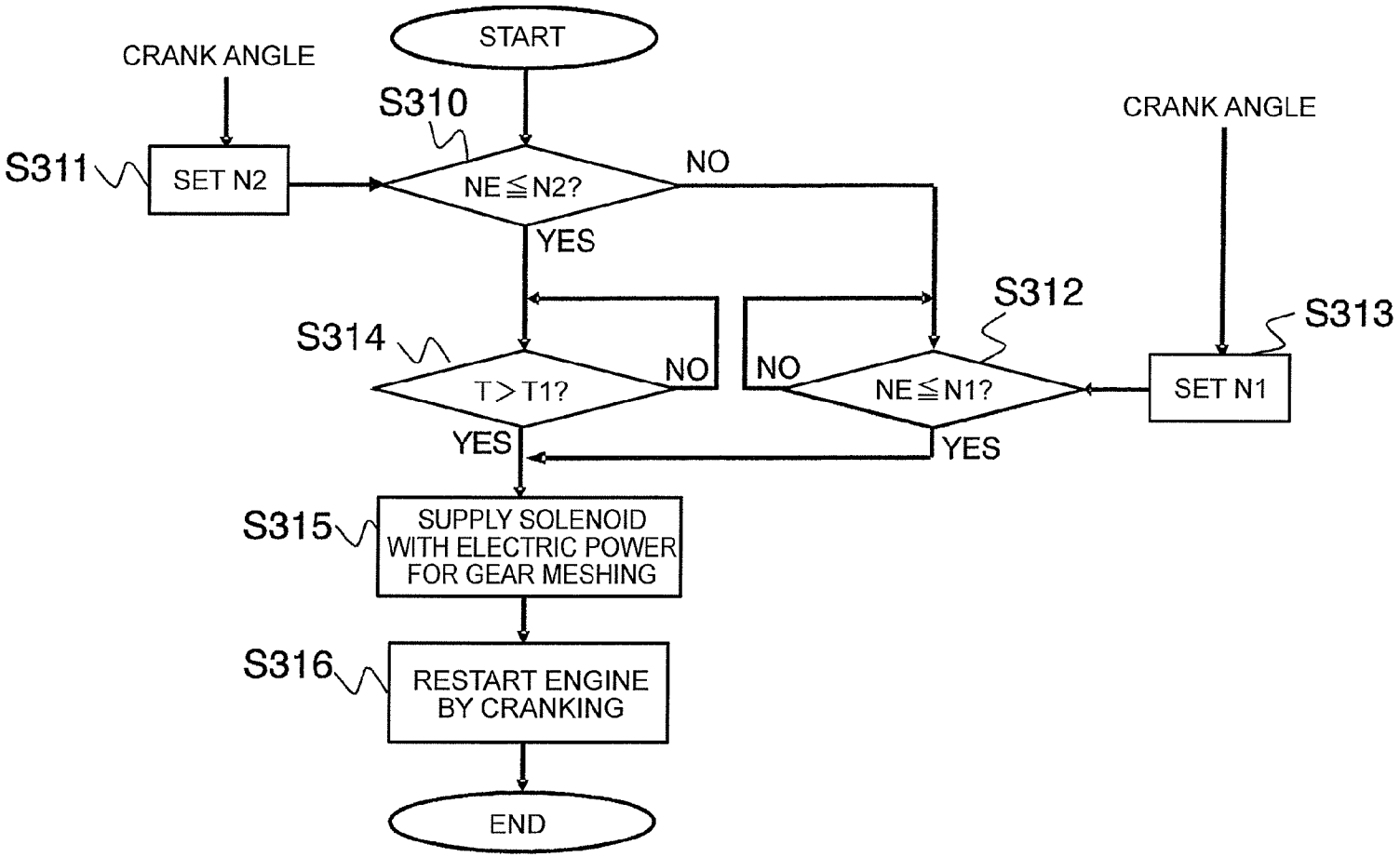
FIG. 11 A flowchart illustrating a sequence of processing relating to the starter control when the restart condition is established according to the second embodiment of the present invention.

Referring to a flowchart illustrated in FIG. 11, a detailed description is given of specifics of processing according to the second embodiment corresponding to the above-mentioned processing of the engine restart control in Step S114 illustrated in FIG. 4. FIG. 11 is a flowchart illustrating a sequence of processing relating to the starter control when the restart condition is established according to the second embodiment of the present invention.

When the restart condition is established, the processing proceeds to Step S310, and the starter control means 11 compares the engine rpm NE and the second predetermined rpm N2 with each other. Then, when NE is equal to or lower than N2, the processing proceeds to Step S314, and when NE is higher than N2, the processing proceeds to Step S312.

On this occasion, the second predetermined rpm N2 is set in Step S311. Specifically, a table on which the corresponding value of N2 is set for each crank angle of the engine is stored in advance, and an appropriate value is set as N2 depending on the crank angle of the engine in the control cycle.

As a result, as described above, when the compression and expansion are repeated due to a change in crank angle, and the engine rpm decreases while presenting pulsation, the meshing inhibition condition can be prevented from being established in an unintended period (corresponding to the above-mentioned times tg to th of FIG. 9).

In Step S310, when the starter control means 11 determines that NE≤N2, as in the case where the starter control means 11 determines that NE≤N2 in Step S210 of FIG. 5 in the above-mentioned first embodiment, the starter control means 11 inhibits the meshing for the predetermined period T1, and after the predetermined period T1 has elapsed, supplies the solenoid 18 with the electric power, thereby causing the gears to mesh with each other, and restarts the engine (Step S314 to Step S316).

Moreover, in Step S310, when the starter control means 11 determines that NE>N2, the processing proceeds to Step S312. On this occasion, the first predetermined rpm N1 is set in Step S313. Specifically, as in N2, a table on which the corresponding value of N1 is set for each crank angle of the engine is stored in advance, and an appropriate value is set as N1 depending on the crank angle of the engine in the control cycle.

As a result, as described above, when the compression and expansion are repeated due to a change in crank angle, and the engine rpm decreases while presenting pulsation, the meshing permission condition can be prevented from being established at an unintended timing (corresponding to the times tc to td of FIG. 7).

In Step S312, when the starter control means 11 determines that NE≤N1, the processing proceeds to Step S315, and the starter control means 11 supplies the solenoid 18 with the electric power, thereby causing the pinion gear 15 to mesh with the ring gear 12. Then, the processing proceeds to Step S316, and the starter control means 11 restarts the engine by cranking.

As described above, the engine starting device according to the second embodiment can carry out, by changing N1 and N2 depending on the crank angle, the meshing permission at appropriate timings and the meshing inhibition in appropriate periods.

According to the second embodiment described above, a description has been given of the case where both N1 and N2 are changed depending on the crank angle, but both of N1 and N2 are not necessarily changed, and any one of N1 and N2 may be changed.

Third Embodiment

In the above-mentioned first and second embodiments, a description has been given of the case where the release of the meshing inhibition condition is determined based on whether or not the elapsed time T after the meshing inhibition condition is established is longer than the predetermined time T1. In contrast, according to a third embodiment, a description is given of a case where whether or not to release the meshing inhibition condition is determined based on the engine rpm.

Figure 12:
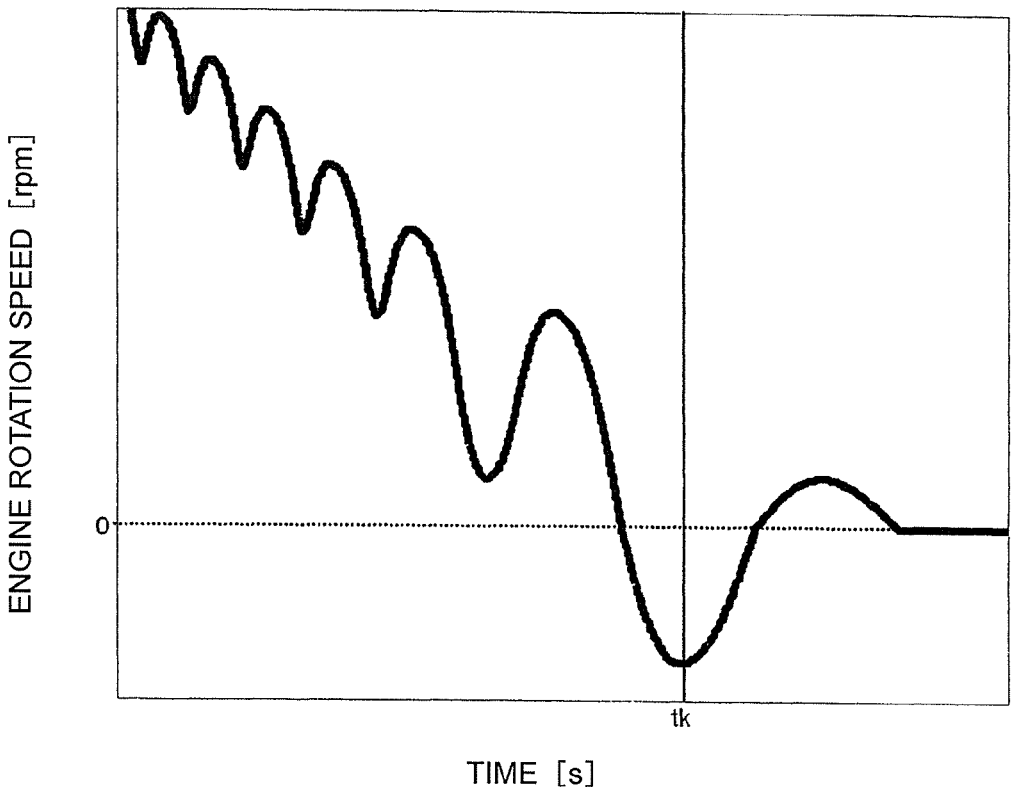
FIG. 12 A conceptual view showing a backward rotation peak of the engine according to a third embodiment of the present invention.

FIG. 12 is a conceptual view showing a backward rotation peak of the engine according to the third embodiment of the present invention. If the engine presents the inertial rotation due to the idle-stop and the engine rotates backward while the meshing inhibition condition is established, a peak (time tk in FIG. 12) of the backward rotation can be determined by determining a change rate in engine rpm for each calculation period or each angle. Thus, according to the third embodiment, the meshing inhibition is released when it is determined that the peak of the backward rotation has passed.

When the meshing inhibition condition has not been established even once at this time point, the meshing inhibition condition may be prevented from being established during the inertial rotation by the idle-stop.

Figure 13:
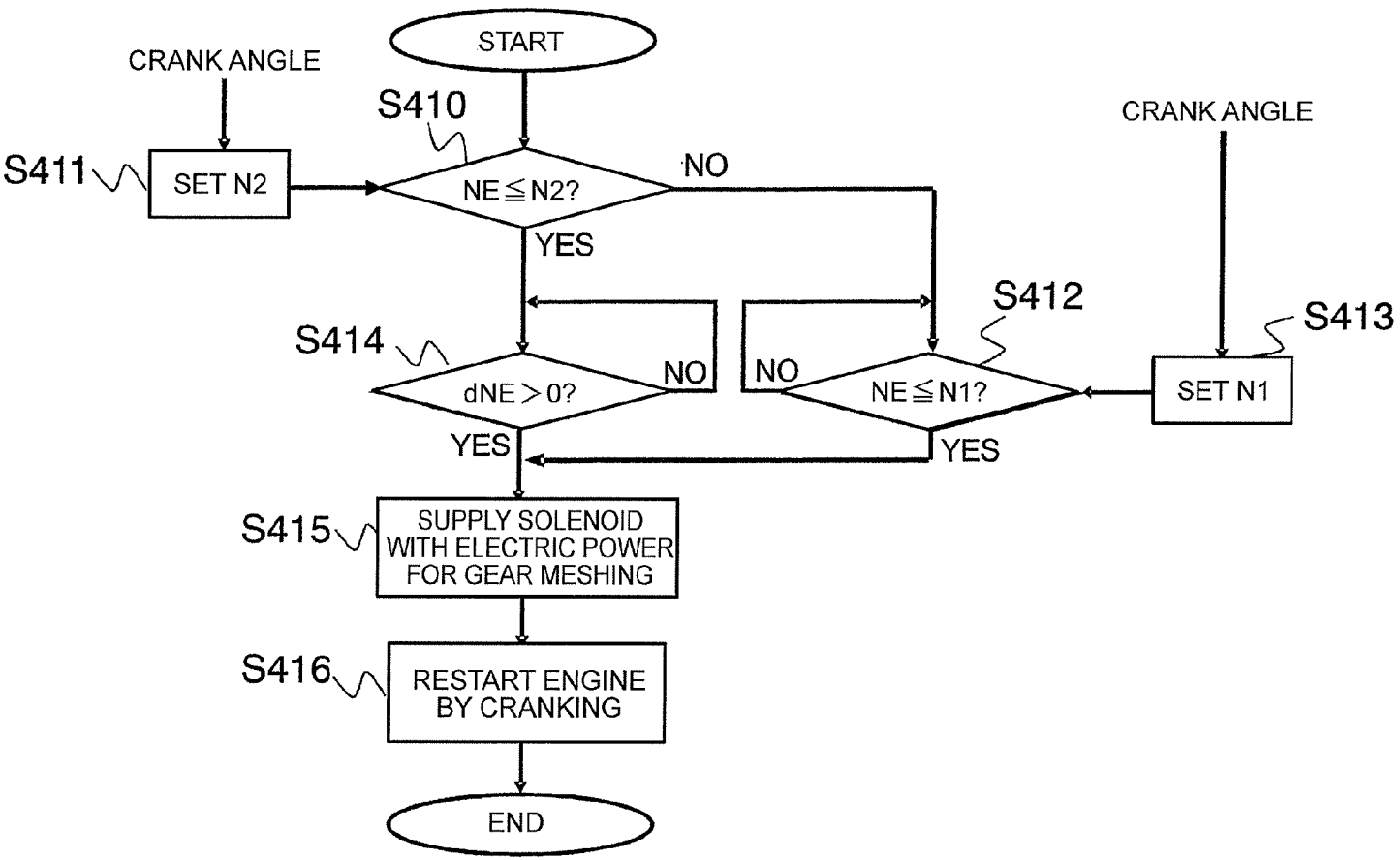
FIG. 13 A flowchart illustrating a sequence of processing relating to the starter control when the restart condition is established according to the third embodiment of the present invention.

Then, referring to a flowchart illustrated in FIG. 13, a detailed description is given of specifics of processing according to the third embodiment corresponding to the above-mentioned processing of the engine restart control in Step S114 illustrated in FIG. 4. FIG. 13 is a flowchart illustrating a sequence of processing relating to the starter control when the restart condition is established according to the third embodiment of the present invention.

When respective Steps S310 to S316 illustrated in the flowchart of FIG. 11 according to the above-mentioned second embodiment and respective Steps S410 to S416 illustrated in the flowchart of FIG. 13 according to the third embodiment are compared with each other, only processing in Step S314 and processing in Step S414 are different from each other, and the other steps carry out the same processing. Therefore, a description is now mainly given of the processing in Step S414 which carries out the processing different from that in the above-mentioned second embodiment.

When the restart condition is established, the processing proceeds to Step S410, and the starter control means 11 compares the engine rpm NE and the second predetermined rpm N2 with each other. Then, when NE is equal to or lower than N2, the processing proceeds to Step S414, and when NE is higher than N2, the processing proceeds to Step S412.

On this occasion, when the processing proceeds to Step S412, the same control as that in the case where the processing proceeds to Step S312 in FIG. 11 according to the above-mentioned second embodiment is carried out, and a description thereof is therefore omitted.

In Step S414, the starter control means 11 determines whether or not an engine rpm change rate dNE is larger than 0. When the starter control means 11 determines that dNE>0, the starter control means 11 determines that the peak of the backward rotation has passed and releases the meshing inhibition condition, and the processing proceeds to Step S415. Then, the starter control means 11 supplies the solenoid 18 with the electric power, thereby causing the pinion gear 15 and the ring gear 12 to mesh with each other, and in Step S416, restarts the engine by cranking.

On this occasion, the engine rpm change rate dNE may be calculated based, for example, on a previous value and a current value at an update timing of the engine rpm NE, or on a moving average of a plurality of pieces of data.

In this way, in Step S414, when the starter control means 11 releases the meshing inhibition by determining whether or not the peak of the backward rotation has passed, in Step S415, the starter control means 11 supplies the solenoid 18 with the electric power, and at the time when the pinion gear 15 meshes with the ring gear 12, the engine rpm NE has already increased to an engine rpm within the meshing permissible range. Therefore, smooth meshing can be carried out.

As described above, the engine starting device according to the third embodiment can release the meshing inhibition condition by determining whether or not the peak of the backward rotation has passed. As a result, the meshing inhibition does not need to be released based on the elapsed time T after the inhibition condition is established as described above in the above-mentioned first and second embodiments, and the meshing inhibition can be released based on the engine rotation behavior.

In the above description of the third embodiment, the release of the meshing inhibition is determined based only on the condition that the peak of the backward rotation has passed or not, but the release of the meshing inhibition may be determined in consideration of the engine rpm in addition to the change rate of the engine rpm.

By means of this determination, when the engine rpm NE falls within the meshing permissible range at the peak of the backward rotation where the change rate of the engine rpm changes from a negative value to a positive value, the engine rpm does not decrease or depart from the meshing permissible range, and hence the meshing inhibition may be released.

Conversely, when the engine rotation speed NE is outside the meshing permissible range, the meshing inhibition is not released, and the meshing inhibition may be released at the time when the predetermined time T1 has elapsed or when the engine rotation speed enters the meshing permissible range.

In this way, by considering both the engine rotation speed and the change rate of the engine rotation speed in the control cycle, the accuracy of the release of the meshing inhibition can be further increased.

Moreover, by considering the delay time after the power supply to the solenoid 18 is started until the pinion gear 15 meshes with the ring gear 12, and using the change rate of the engine rotation speed, the engine rotation speed when the delay time Td has elapsed is estimated, and when the estimated engine rotation speed enters the meshing permissible range, the meshing inhibition may be released. In this way, by considering the change rate of the engine rotation speed in the control cycle, the accuracy of the release of the meshing inhibition can be further increased.

The invention claimed is:

1. An engine starting device for an automatic idle-stop system for carrying out an idle-stop of an engine when a predetermined idle-stop condition is established, and then restarting the engine when a restart condition is established, the engine starting device comprising:

a starter;

a ring gear to be coupled to a crankshaft of the engine;

a starter motor for starting the engine;

a pinion gear for transmitting a rotation of the starter motor to the ring gear; and starter control means for causing, when the restart condition for the engine is established during a period in which a meshing permission condition for the ring gear and the pinion gear is established, the pinion gear and the ring gear to mesh with each other, thereby restarting the engine, and for inhibiting, when the restart condition is established during a period in which a meshing inhibition condition for the ring gear and the pinion gear is established, the meshing of the pinion gear and the ring gear so that the meshing of the pinion gear and the ring gear is prevented from occurring outside a meshing permissible range, and after the meshing inhibition condition is released, causing the pinion gear and the ring gear to mesh with each other, thereby restarting the engine, wherein the starter control means determines the meshing permission condition and the meshing inhibition condition based on at least an engine rotation speed, and determines the release of the meshing inhibition condition before the engine completely stops based on an elapsed time after the establishment of the meshing inhibition condition.

2. An engine starting device according to claim 1, wherein the starter comprises a solenoid for moving the pinion gear, and has such a configuration that power supply to the starter motor and power supply to the solenoid are operationally associated with each other.

3. An engine starting device according to claim 1, wherein the starter control means determines a change rate of the engine rotation speed to detect a peak of a backward rotation during an inertial rotation of the engine caused by the idle-stop, and performs one of preventing the meshing inhibition condition from being established and releasing the meshing inhibition condition when it is determined that the peak of the backward rotation has passed.

4. An engine starting device according to claim 3, wherein when the starter control means determines that the peak of the backward rotation has passed, and that the engine rotation speed at the peak of the backward rotation falls within a meshing permissible range, the starter control means performs the one of preventing the meshing inhibition condition from being established and releasing the meshing inhibition condition.

5. An engine starting device according to claim 3, wherein when the starter control means determines that the peak of the backward rotation has passed, and uses the change rate of the engine rotation speed to estimate an engine rotation speed after a delay time until the pinion gear meshes with the ring gear has elapsed, and determines that the estimated engine rotation speed falls within a meshing permissible range, the starter control means performs the one of preventing the meshing inhibition condition from being established and releasing the meshing inhibition condition.

6. An engine starting device according to claim 1, wherein the starter control means establishes the meshing permission condition when the engine rotation speed is equal to or lower than a first predetermined rotation speed, and establishes the meshing inhibition condition when the engine rotation speed is equal to or lower than a second predetermined rotation speed lower than the first predetermined rotation speed.

7. An engine starting device according to claim 6, wherein at least one of the first predetermined rotation speed and the second predetermined rotation speed is set depending on a crank angle of the engine.

8. An engine starting device according to claim 1, wherein when the starter control means releases the meshing inhibition condition after the meshing inhibition condition is established during an inertial rotation of the engine, the starter control means avoids establishing the meshing inhibition condition again until the engine restarts.

9. An engine starting device for an automatic idle-stop system for carrying out an idle-stop of an engine when a predetermined idle-stop condition is established, and then restarting the engine when a restart condition is established, the engine starting device comprising:

a starter;

a ring gear to be coupled to a crankshaft of the engine;

a starter motor for starting the engine;

a pinion gear for transmitting a rotation of the starter motor to the ring gear; and starter control means for causing, when the restart condition for the engine is established during a period in which a meshing permission condition for the ring gear and the pinion gear is established, the pinion gear and the ring gear to mesh with each other, thereby restarting the engine, and for inhibiting, when the restart condition is established during a period in which a meshing inhibition condition for the ring gear and the pinion gear is established, the meshing of the pinion gear and the ring gear so that the meshing of the pinion gear and the ring gear is prevented from occurring outside a meshing permissible range, and after the meshing inhibition condition is released, causing the pinion gear and the ring gear to mesh with each other, thereby restarting the engine, wherein the starter control means determines the meshing permission condition and the meshing inhibition condition based on at least an engine rotation speed, and determines the release of the meshing inhibition condition before the engine completely stops based on the engine rotation speed and an elapsed time after the establishment of the meshing inhibition condition.

10. An engine starting method for an automatic idle-stop system for carrying out an idle-stop of an engine when a predetermined idle-stop condition is established, and then restarting the engine when a restart condition is established, the engine starting method being applied to an engine starting device comprising:

a starter;

a ring gear to be coupled to a crankshaft of the engine;

a starter motor for starting the engine;

a pinion gear for transmitting a rotation of the starter motor to the ring gear; and starter control means for causing, when the restart condition for the engine is established during a period in which a meshing permission condition for the ring gear and the pinion gear is established, the pinion gear and the ring gear to mesh with each other, thereby restarting the engine, and for inhibiting, when the restart condition is established during a period in which a meshing inhibition condition for the ring gear and the pinion gear is established, the meshing of the pinion gear and the ring gear so that the meshing of the pinion gear and the ring gear is prevented from occurring outside a meshing permissible range, and after the meshing inhibition condition is released, causing the pinion gear and the ring gear to mesh with each other, thereby restarting the engine, the engine starting method comprising:

determining, by the starter control means, the meshing permission condition and the meshing inhibition condition based on at least an engine rotation speed; and determining, by the starter control means, the release of the meshing inhibition condition before the engine completely stops based on an elapsed time after the establishment of the meshing inhibition condition.

* * * * *